United States Patent [19]

Rouleau et al.

[11] Patent Number: 4,635,918

[45] Date of Patent: Jan. 13, 1987

[54] PROCESS AND APPARATUS FOR GRIPPING FLEXIBLE, AND IN PARTICULAR TEXTILE LAYERS, AND A MACHINE FOR GRIPPING AND TRANSFERRING SAID LAYERS

[76] Inventors: Alain Rouleau, 3 rue Espinasse; Patrick Rouleau, 52, boulevard Carnot, both of 3100 Toulouse; Jean-Pierre Touret, 21, rue des Roitelets, 31270 Villeneuve Tolosane, all of France

[21] Appl. No.: 712,197

[22] Filed: Mar. 15, 1985

[30] Foreign Application Priority Data

Mar. 26, 1984 [FR] France ..... 84 04804

[51] Int. Cl.[4] ..... B65H 3/22

[52] U.S. Cl. ..... 271/183; 294/61; 271/19

[58] Field of Search ..... 271/18.3, 16, 18, 19, 271/42, 118, 119, 120, 141, 142, 161, 168, 204, 206, 209; 294/61

[56] References Cited

U.S. PATENT DOCUMENTS

| | | | |
|---|---|---|---|
| 3,402,833 | 10/1968 | Pershing | 294/61 |
| 3,813,094 | 5/1974 | Walton et al. | 271/18 X |
| 4,008,888 | 2/1977 | Vinciguerra | 271/18.3 |

FOREIGN PATENT DOCUMENTS

| | | | |
|---|---|---|---|
| 2252941 | 5/1974 | Fed. Rep. of Germany | 294/61 |
| 2401737 | 7/1974 | Fed. Rep. of Germany | 271/18.3 |
| 1031868 | 7/1983 | U.S.S.R. | 294/61 |

*Primary Examiner*—George E. A. Halvosa
*Assistant Examiner*—Lawrence J. Goffney, Jr.
*Attorney, Agent, or Firm*—Harold H. Dutton, Jr.

[57] ABSTRACT

A process for gripping flexible layers arranged in a stack of layers in order to separate one or more upper layers from the other layers of the stack makes use of a needle (23) moving with respect to a contact surface (14*a*) with a clearance (16). The motion of the needle (23) is implemented in such a manner that during the displacement of its end, said needle thrusts the upper flexible layer toward the clearance (16) to form a corrugation in said clearance; during the final stage of the motion, the needle crosses said corrugation.

36 Claims, 19 Drawing Figures

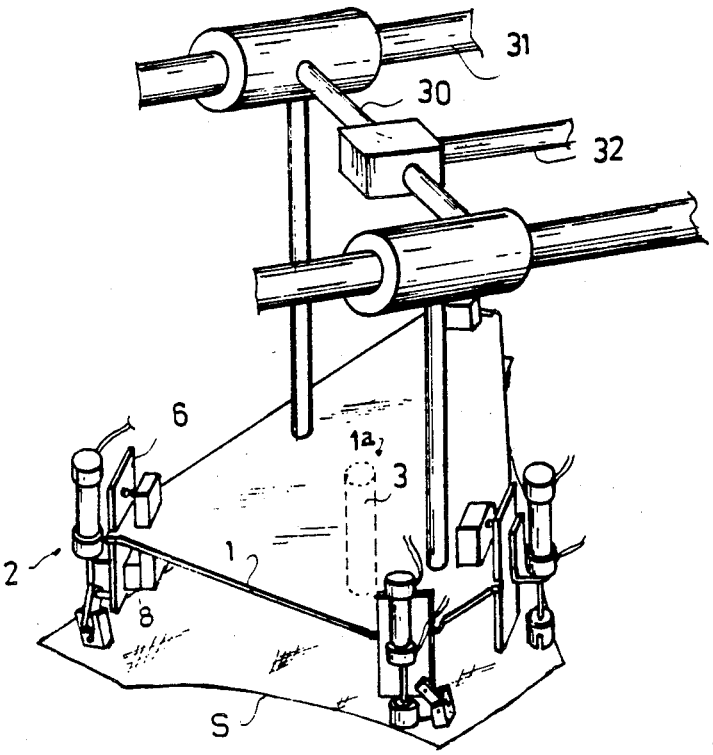
Fig. 8
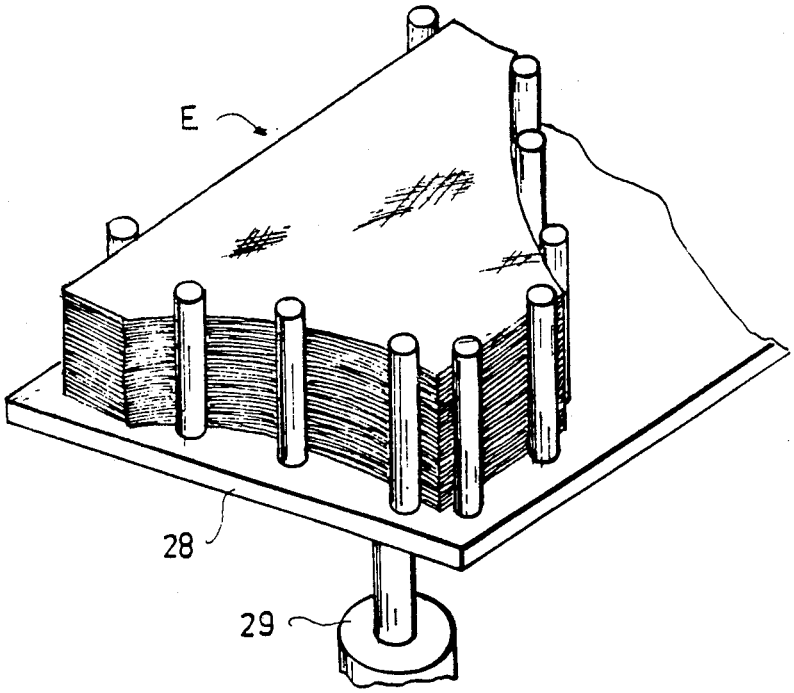

Fig. 9
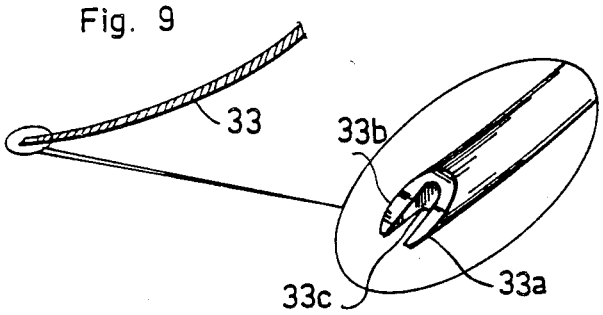
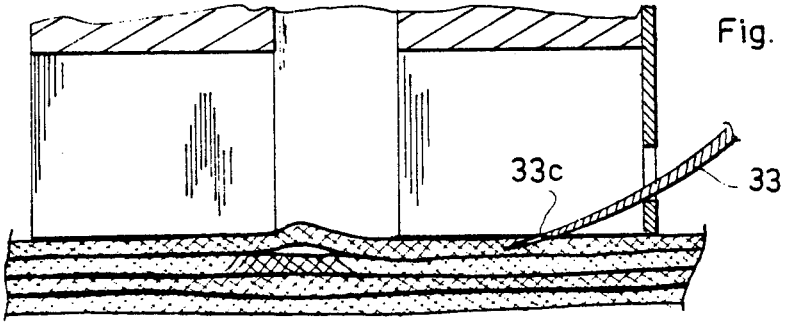
Fig. 10a
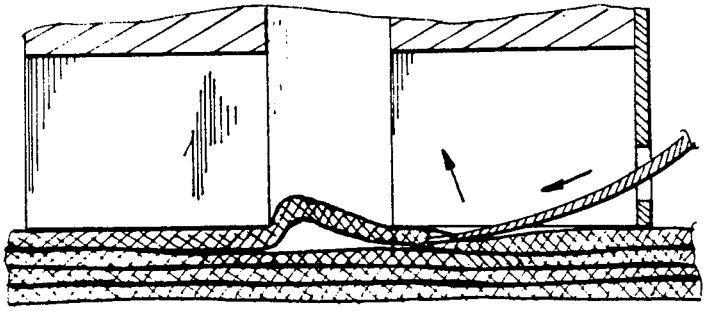
Fig. 10b
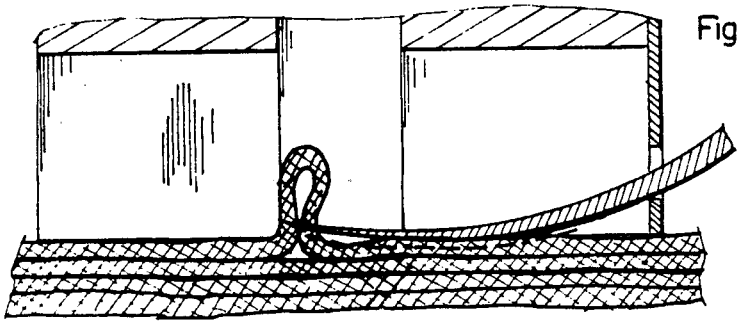
Fig. 10c

PROCESS AND APPARATUS FOR GRIPPING FLEXIBLE, AND IN PARTICULAR TEXTILE LAYERS, AND A MACHINE FOR GRIPPING AND TRANSFERRING SAID LAYERS

This invention relates to a process and an apparatus for gripping flexible, and in particular textile such as knit, woven, or other, layers. The invention relates in addition to a machine enabling the transfer of these layers from one or more stacks, where the layers are stored in superposed positions, to one or more other sites.

BACKGROUND AND OBJECTS OF THE INVENTION

In the textile and knitwear industry, substantial difficulties are presently encountered in automating the procedures to be carried out on knit or woven layers to make them into semi- or wholly finished goods due to the complexity in seizing these layers whether individually or in specified numbers from stacks of cut-outs; these layers most of the time are exceedingly thin (with thicknesses often less than a millimeter) and tend to adhere to one another whereby the gripping and the separation of the upper layer or of a specific number of layers above a stack amount to exceedingly delicate operations (even when carried out manually).

Presently, there is no device which proves entirely satisfactory for this work in a reliable manner compatible with automation. Essentially there are four types of grippers:

"Velcro" or hook-and-loop type hooking tape grippers which incur the drawback that they are applicable only to certain kinds of knits (inoperative with respect to most woven fabrics) and that it is difficult to detach them from the gripped layer;

adhesive grippers providing good seizure but entailing detachment difficulties similar to those mentioned above;

roller-type grippers operating by squeezing the woven fabric or knit but suffering from the drawback that their operation is highly uncertain and that they cause deep pleats in the flexible layers;

crossed-needle grippers.

A gripper of this last mentioned type is described in French patent application No. 2,468,531 (U.S. Pat. No. 4,386,770), and in the application for certificate of addition No. 2,482,064. The flexible layer is gripped by two needles extending crosswise from a casing and penetrating obliquely into one, or several, layers of the stack. Because they cross each other, these needles retain the layer(s) which they penetrate.

While such a device is fairly effective as regards knits or woven fabrics, it is wholly unreliable as regards the thin knits or woven fabrics (several tenths of a millimeter). If, for instance, a single layer is to be seized, the needles descending into the fabric must not penetrate beyond one layer thickness, or else the layer below shall be gripped too. Considering the material flexibility and elasticity, a penetration of several tenths of a millimeter is inadequate to assure suitable gripping in spite of the crossing of the needles, and quite frequently the fabric will accidentally come off while being transferred.

Moreover, as regards this kind of gripper, many precautions must be taken in detaching the lower layer tending to adhere to the seized one which is only passably held. For that reason, the designers of these kind of grippers were led, as described in the above cited application for certificate of addition, to provide hollow needles entering the fabric as far as the immediate vicinity of the inner surface of the layer to be gripped, applying a compressed air jet to the lower layer to detach it without undue risk of losing the gripped layer. In practice such detachment is, however, of low effectiveness because the device implementing the method is comparatively costly (in particular the hollow needles cost much more than ordinary needles with similar dimensions).

Elsewhere a technique for gripping fabric has been described in German patent No. 2,002,750 and in French patent No. 2,218,417 (U.S. Pat. No. 4,008,888) whereby a curved needle is made to rotate about its center of curvature so that it will project with respect to a plate and enter the fabric which is wholly immobilized, this curved needle then issuing again from the fabric on the same side at the end of its circular motion.

When the fabric pieces are stacked one upon the other, obviously and as emphasized in these patents, the needle must in the course of its circular motion about its center of curvature project from a plate by a depth less than the thickness of the layer to be seized. Otherwise, the needle also would seize the adjacent layer which it would then penetrate. Under these conditions, only one fiber or a small number of fibers of the layer to be separated are being seized by the needle.

Where thin layers are concerned (a few tenths of a millimeter), the same drawback as met by the crossed needles is encountered here, where these crossed needles provided only slightly effective gripping with a reliability below that required for automated procedures. To the knowledge of the inventors, this type of technology using a single curved needle rotating about its center of curvature never has been applied in spite of its relative age, presumably because of this major drawback of uncertain seizure and separation of a thin layer from the others of a stack. Furthermore, it is likely that such a device frequently must cause fabric degradation by rupturing the few fibers captured by the needle.

The object of the present invention is to remedy the above cited drawbacks of the known gripper means. This invention provides a novel gripping apparatus whereby gripping is assured using a needle in conditions suitable to eliminate all of the drawbacks of the known grippers and in particular of the crossed-needle grippers and of the curved needle grippers rotating about their centers of curvature.

In particular, another object of the invention is to simultaneously achieve the three conditions essential for sound operational reliability: reliable gripping of the layer(s) to be seized, assured detachment of such layer(s) with respect to the lower layers, and safe disengagement of such layer(s) when being deposited.

Another object is to achieve these results by means of compact gripper apparatus of simply design and low cost.

Another object of the invention is directly related to the above objects (reliability, low cost and compactness) and provides a gripper and transfer machine for textile parts making it possible through several gripper means to seize and to transfer pieces of any size and shape with outstanding reliability.

The difficulties in overcoming the above cited objects can be gauged in the case of thin layers superposed in a stack, namely in that the two conditions:

firmly gripping the upper stack layer to detach it from the other layers and to transfer it in the absence of danger of losing it, and simultaneously avoiding seizing the lower layer which in that event no longer could be detached, appear incompatible, in particular where a needle gripper is used. Either the needle penetration is limited to a depth less than the layer thickness, and in this case the layer is seized only across the minute thickness of a few fibers, and the seizure is low in effectiveness, or else the needle is made to penetrate deeper and the lower layers are seized.

The present invention resolves the problem raised by this apparent incompatibility and relates to a process and a needle apparatus suitable to allow simultaneously firmly gripping one or more thin layers and assured detachment from the lower layer which must stay in place.

DESCRIPTION OF THE INVENTION

To that end, the process proposed by the invention is of the type including the following operations:

a contact surface with a clearance is applied to at least one zone of the upper flexible layer of the stack, said layer remaining free at the clearance, then a needle is moved with respect to said contact surface in such a manner that the needles sharp tip moves with respect to said contact surface acting as a reference along a path T including in succession first an initial segment Ti from the contact surface and deviating from it so as to make the needle enter the flexible layer, then a return segment Tr including a reversal in relative direction of motion between the needle tip and the contact surface, lastly an end segment Tf which nears the contact surface while being offset from the initial segment so as not to coincide with it;

lastly, generation of a relative separating motion between the stack and the assembly of needle and contact surface.

In the present invention, the needle motion is implemented in such a manner that while moving the sharp tip along the initial segment Ti and along the return segment Tr, this needle forces the flexible layer toward the clearance and corrugates it inside this clearance, the end segment Tf of the path passing through said corrugation.

Such a procedure can be implemented by using a hollow concave needle with the concave part oriented in the same direction as the path (T). However, implementation also can be in the form of a differently shaped needle, in particular a straight one, or partly straight, or an angled one.

In a preferred embodiment of the invention, the needle is positioned in the course of its displacement along the initial segment (Ti) and along the return segment (Tr) in such a manner that at each point the direction of the needle tip (defined for a curved needle by the tangent to this needle's tip) shall not coincide with the tangent to the path so as to assure the above cited thrust on the flexible layer. Preferably the needle is positioned in such a way that its tip direction be above the tangent to the itinerary in order to provide —as will be further discussed below—a thrust to raise the flexible layer toward the clearance in the contact surface.

In another implementation of the invention, which preferably is combined with that above, a needle is used with an end evincing at least one tip, and upstream of latter, a stop means to come to rest against the flexible layer. This stop means assures or substantially increases the thrust on the fabric of the upper layer and causes or substantially facilitates the corrugation of the fabric. In particular a needle may be used with two tips apart at its ends. In that case, the stop means comprises that part of the needle which is located between the bases of said tips.

Accordingly, the process of the invention corrugates the layer to be seized within the clearance of the contact surfaces and pierces this corrugation in the manner of a stitch by passing through the layer. The fabric is held by the needle over its entire thickness and at the end of the needle motion is clamped at its corrugation in the manner of a stitch by passing through the layer. The fabric is held by the needle over its entire thickness and at the end of the needle motion is clamped at its corrugation between said needle and the contact surface. In this way the gripping is by all the fibers jointly with clamping a small part of the fabric and accordingly is exceedingly firm. Experiment has shown that the danger of loss is negligible even in the case of the thinnest possible fabric layers.

As will be better understood further below, the gripping of the fabric by piercing and clamping a corrugation formed in it is compatible with displacing the needle (with respect to the contact surface) in such a manner that the itinerary of its end is very flat near its return segment (Tr). Under these conditions it is easy to adjust the height of this displacement so that a single layer or a specified number of layers be seized.

In the preferred embodiment of a stop-equipped needle, this needle advantageously is associated with elastic means to keep it away from the contact surface, this needle being mounted in such a manner that it can slightly retract toward the contact surface. In this manner there is no need for a highly precise control of the needle motion. When the needle stop comes to rest against the fabric, the needle's capability to retract automatically limits the displacement height of the needle tip. In that case it is easily possible, even for very thin layers, to displace the needle in such a way that following penetration, the return segment (Tr) of the path (T) be located some distance from the contact surface which is equal to, or less than, the thickness of the layer(s) to be seized. In that manner, no lower layers will be seized accidentally.

In particular, the process of the invention can be implemented according to the following modes:

The needle displacement with respect to the contact surface is achieved by rotating the needle about an axis transversely offset from the center of curvature of the needle for the case of a curved needle. This axis is located opposite the flexible layers with respect to the plane of the contact surface and is itself translating with respect to the compression surface which tends to move it closer to this plane.

The compression surface is applied to the upper stack flexible layer by a relative nearing motion between said stack and said contact surface and carried out in such a manner that the pressure exerted by the contact surface on the stack be substantially uniform and fairly low so as not to significantly compress the flexible layer(s).

At the end of the final displacement segment (Tf) of the needle, it si locked in place with respect to the contact surface and it is kept locked during the relative separation motion between the stack and the assembly of needle and contact surface.

The fabric gripping described under the above conditions assures that the material shall be firmly and safely kept in place, whereby the detachment from the lower layers is much facilitated.

Once the layer(s) is or have been seized, it is possible in particular to move the assembly of needle and contact surface (against which the layer(s) is or are firmly held) in several rapid to-and-fro motions in a direction substantially parallel to the plane of the contact surface. These motions break up the adhering forces between the seized layers and the immediately adjacent layer which remains adhering to the other layers of the stack.

Again it is possible, also in combination with the above implementation, to blow air above the flexible upper layer in such a direction as to separate it from the plane of the contact surface. This insufflated air tends to shape the seized layer outside the gripped zones into a basin which by its bottom rests against the lower layers, whereby detachment is made possible or enhanced. Furthermore, and in particular as regards very thin layers, the air passes through the seized layer(s) and sets up a detaching counter-pressure on the lower layers.

One should bear in mind that in view of the seized layer(s) being very firmly held in place, this air insufflation is implemented by very simple nozzles arranged above the layers without need for hollow needles as in the case of the crossed needles method.

Following the relative separation motion of the seized layer and the stack, this layer detachment is achieved very easily by moving each needle in the inverse direction with respect to its contact surface so as to return each of said needles to its initial position and} retracted with respect to said contact surface. Thereupon the layer(s) no longer being held in place will now spread apart by the gravity of the contact surfaces to drop where desired. Therefore the process of the invention is not susceptible to the disengagement difficulties encountered by the adhesive and Velcro type grippers.

The invention also covers means for implementing the above states process including at least one head provided with a contact surface evincing a clearance, a needle associated with said head and moving with respect to it, and kinematic guides for each needle to guide them with respect to the corresponding head, imposing on the needle tip a path (T) (with respect to the contact surface taken as the reference) that includes an initial segment (Ti), a return segment (Tr) and an end segment (Tf) which are such as defined previously in order to assume a C-shape with the concave side pointing to the head contact surface.

In one feature of the invention, the kinematic guides are designed to move the corresponding needle in such a manner that the direction of its tip is different from the tangent to the path (T) at least on the initial segment (Ti) and on the return segment (Tr) of this path.

In another feature preferably combined with the preceding one, the needle has at least one tip and, upstream of this tip, a stop to come to rest against the flexible layer. In particular, the needle advantageously includes two tips which are apart, the stop being formed by the part located between the bases of the tips.

In other features of the invention, the apparatus is designed in the following manner:

each head is provided with a thin groove of which the depth slightly exceeds that of the needle thickness, extending in a plane substantially perpendicular to the contact surface and intersecting the clearance in the head;

the kinematic guides are designed to constrain an initially entirely retracted position of the needle within the groove and a final position at the end of the motion wherein at least the tip of said needle is retracted into said groove;

the kinematic guides are designed so that the end portion (Tf) of the needle tip path intersects the plane of the contact surface at said clearance.

In a preferred embodiment, the kinematic guides for each needle include:

a hinge link designed to support the needle in such a manner that for the preferred case of a curved needle, the needle concave side is facing in the same direction as the path (T);

a hinge spindle of the link and resting in such a manner in a support that said spindle is transversely offset from the head and for the preferred case of a curved needle is located on the concave side of the needle and offset from its center of curvature;

translating guides designed to allow a relative translating motion between the hinging spindle support and the head;

a needle guide aperture in an element solidly joined to the head and designed so as to constrain its displacement along the path (T) to the needle when the head and the spindle are subjected to the above cited relative motion of translation, elastic means associated with the needle supporting rod so as to separate it from the head toward an end stop position.

Lastly the invention applies to a machine for gripping and transferring flexible layers individually or in specific numbers. In substance this machine includes:

at least one mobile stack support;

a gripping system of the above described type located above said stack support and with its contact surface opposite said support; and drive means for the stack support to raise or lower it with respect to the gripping system.

DESCRIPTION OF THE DRAWINGS

Other features, purposes and advantages of the invention shall become clear in relation to the following description and attached drawings showing in illustrative and non-restrictive manner a preferred mode of embodiment. These drawings are an integral part of the present description.

Figure 1:
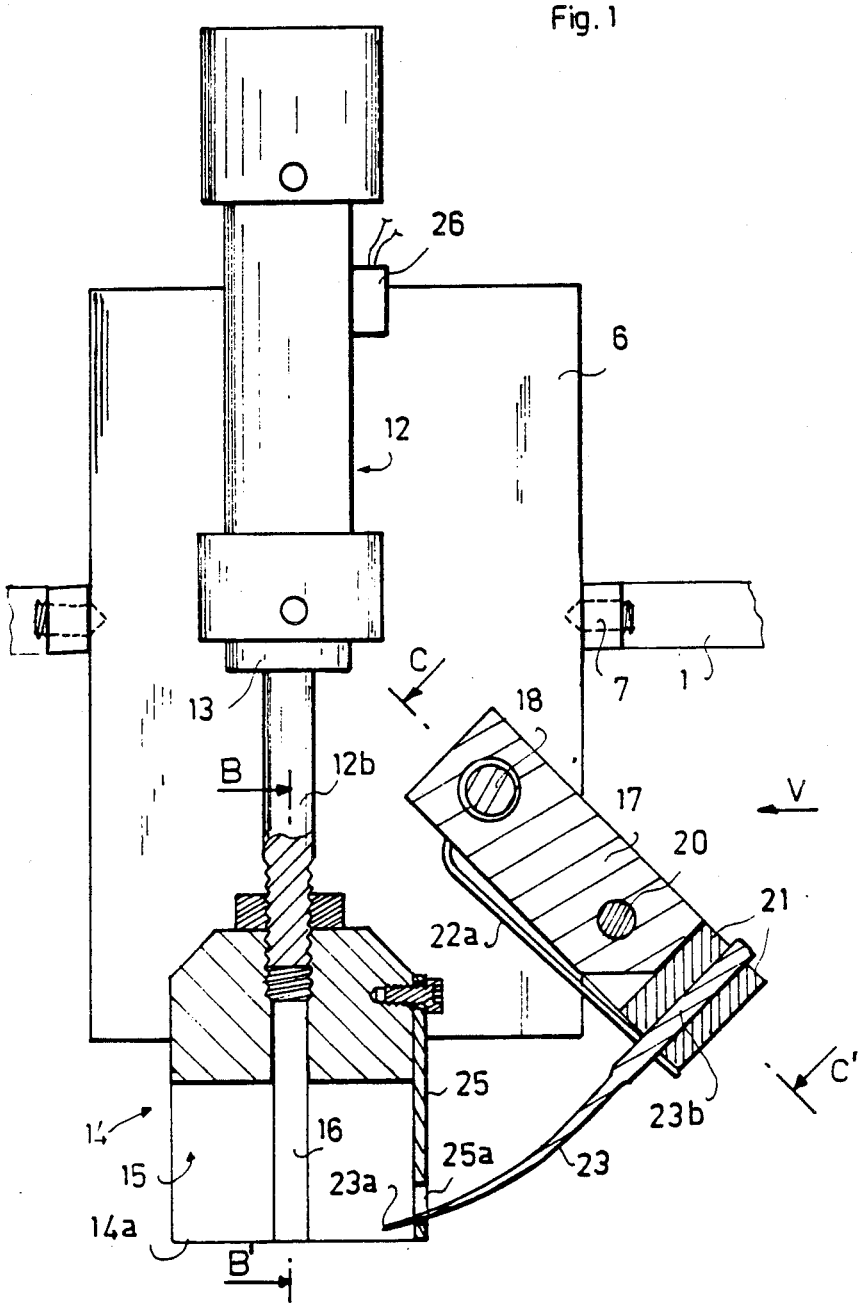
FIG. 1 is a front view partly in section through a vertical plane AA' of a gripping apparatus of the invention.
Figure 2:
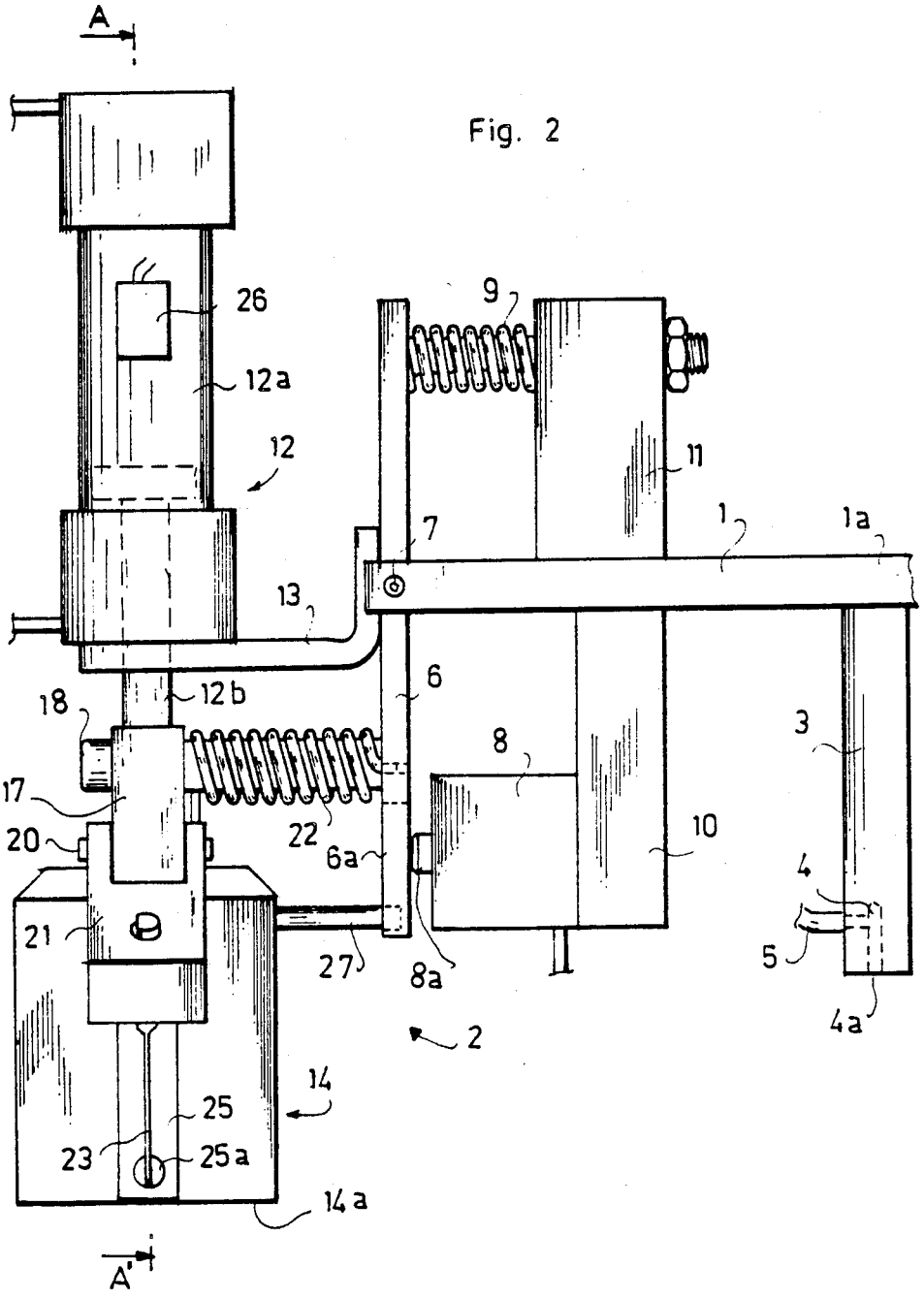
FIG. 2 is a side view along the arrow V.
Figure 4:
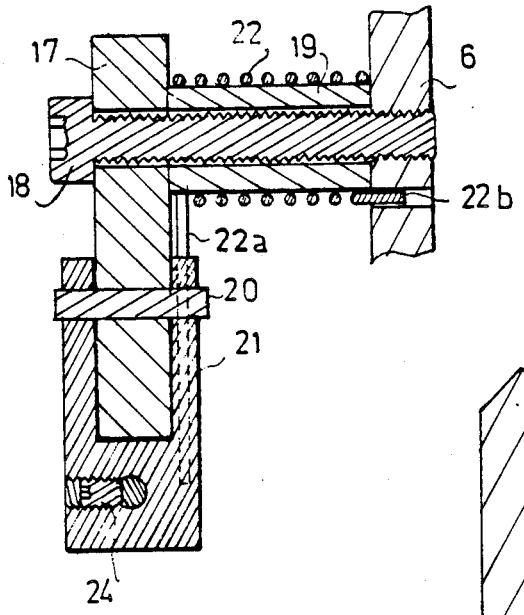
FIGS. 3 and 4 are detailed sections respectively along lines BB' and CC'.
Figure 3:
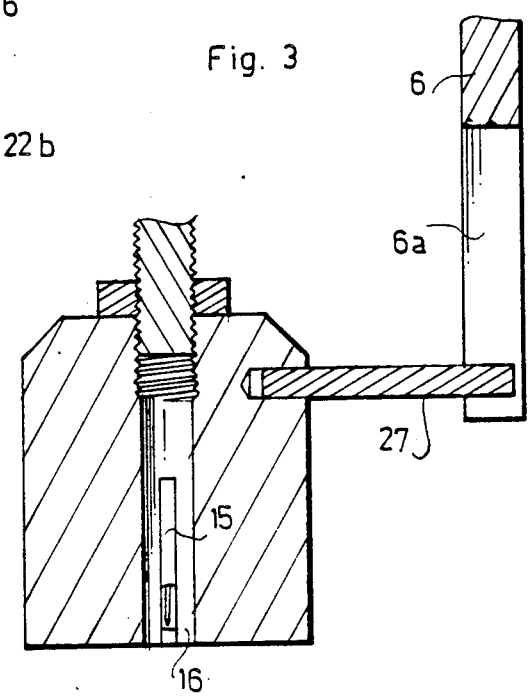

FIGS. *7a, 7b, 7c, 7d, 7e, 7f* and *7g* are schematics on a greatly enlarged scale showing the various operational stages of the apparatus;

FIG. 8 is a schematic perspective of a gripping and transferring machine of the invention while in operation;

FIG. 9 is a variation shown on an enlarged scale of a two-tip needle for equipping the apparatus particularly in the case of very thin layers; and FIGS. 10*a*, 10*b* and 10*c* are illustrative and greatly enlarged diagrams for the case of a two-tip needle such as shown in FIG. 9.

DESCRIPTION OF THE PREFERRED EMBODIMENTS

The gripping apparatus illustratively shown in FIGS. 1–4 includes a framework 1 supporting several assemblies 2 located around a central region 1*a* and of which the structure is described in detail further below. The number of the assemblies 2 and their distribution depends on the shape and sizes of the textile pieces which must be gripped (hereafter termed fabric pieces whether they be woven, knit or other). Illustratively as regards small pieces being put into a trapezoid and used in particular to fabricate a slip, these assemblies may be four in number and pairwise opposite so as to seize each piece near an angle.

As shown further below, the framework 1 may be equipped with transfer means allowing to move it between several locations to seize or deposit the pieces.

The framework is provided with air-blowing means at its central region, the direction of blowing being substantially vertical (or in a direction intersecting the horizontal plane). This means includes a support 3 pointing downward and crossed at its end by a line 4 connected to a flexible air supply tube 5. The air issues from the line 4 through an orifice 4*a* pointing downwardly.

Each assembly 2 includes a plate 6 arranged in a nearly vertical plane; this plate hinges by means of two cone-pointed screws such as 7 on two lugs of the framework 1 so as to perform low-amplitude tipping motions about a horizontal axis through the screws 7 and with respect to this framework.

The plate 6 is equipped with means for driving it into rapid pivoting motions about the screws 7.

In this embodiment, these means comprise, on one hand, a single action jack 8 with a mobile projecting rod 8*a* resting against the lower part of the plate 6 and on the other hand of a return spring 9 acting on the upper part of said plate. Supports 10 and 11 solidly joined to the framework 1 allow mounting these means into suitable positions.

The plate 6 supports the body 12*a* of a dual action pneumatic jack 12 by a bracket 13 rigidly joined to said plate and forming a projection beyond the framework 1. The body 12*a* of the jack is fixed on the bracket 13 as shown in the FIGS. 1 and 2 in such a manner that the mobile rod 12*b* of said jack substantially points down vertically.

The jack 12 is equipped with a known-type proximity sensor 26 (in particular a magnetic one) which detects the high position of its piston and in that case emits a control signal to lock it in that position.

A gripper head 14 is screwed at the lower part onto the end of the rod 12*b* of the pneumatic jack 12. This head comprises a cylinder section with a horizontal plane lower base 14*a* acting as a contact surface for the fabric to be seized. This head is partly slotted by a thin groove 15 of which the thickness slightly exceeds that of a classical stitching needle. This groove extends in a vertical plane which is substantially perpendicular to that of the horizontal contact surface and issues along a diameter of this contact surface.

Furthermore the head 14 is provided with a clearance 16 which in this embodiment is of circular cross-section and which also issues on the contact surface 14*a* and extends on either side of the plane including the groove 15. (In this embodiment, the clearance 16 comprises the extension of a threaded hole permitting to screw the head 14 on the jack rod 12*b*).

The head 14 is provided with a clearance 16 which in this embodiment is of circular cross-section and which also issues on the contact surface 14*a* and extends on either side of the plane including the groove 15. (In this embodiment, the clearance 16 comprises the extension of a threaded hole permitting to screw the head 14 on the jack rod 12*b*).

The head 14 is provided with a stud 27 sliding in a suitable recess 6*a* in the plate 6 to prevent the head from rotating on itself (about its vertical axis) and to assure it is guided during its vertical translation.

The plate 6 includes a support 17 fixed to it in a position transversely offset from the head 14. This support is fixed on the plate by a bolt 18 and a tubular spacer 19 making it possible to position it in a pre-adjusted position with respect to the plate 6.

This support 17 bears a hinging spindle 20 about which link 21 may pivot. This spindle 20 is transversely offset from the axis of the head 14 and is located above the contact surface 14*a*.

Elastic means are associated with the link 21 and are designed to act upon it so it will move away from the head and toward an end position where it rests against the support 17 (this position is shown in FIG. 1). In this embodiment, this elastic means comprises one end 22*a* of a spring 22 resting against the line 21. This spring is coiled around the tubular spacer 19 and its other end 22*b* is clamped into a bore in plate 6.

The link 21 is provided with an aperture to pass and mount a curved needle 23. This needle is of the conventional stitching type and includes at the other end from its tip 23*a*, a heel 23*b* housed in the above mentioned aperture of the link 21 where it is clamped in a preadjusted position by a tightening screw 24.

The needle positioning means (spacer 19, support 17, link 21 and locking aperture for the heel 23*b*) are designed (within the dimensions of the thicknesses) so that said needle be located in the plane of the head groove 15 and can move in this plane with respect to the head by means of the link 21 rotating about its spindle 20. The concave side of the needle points upwardly and its center of curvature is located between the hinging spindle 20 and the vertical axis of the head in a position closer to this vertical axis so as to be highly offset from the spindle 20.

The needle 23 passes through a guide aperture 25*a* in an element solidly joined to the head (in this embodiment, a strip 25 fixed in preset position on the head). This guide aperture 25*a* and the already cited positioning means at any time determine the relative position between the needle and the head and are adjusted in such a way as to impart to it the motions discussed below.

Figure 5:
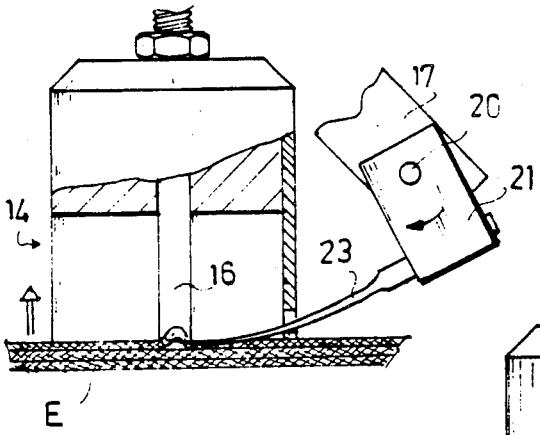
FIGS. 5 and 6 schematically show the apparatus head and its needle respectively in an intermediate, engaged position of a layer and in the final engaged position.
Figure 6:
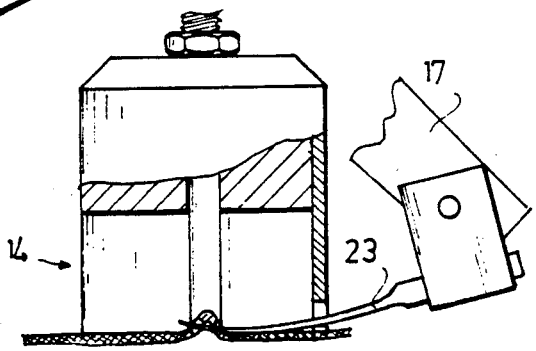

When subjected to a vertical thrust, the head 14 rises towards its high and retracted position, and the needle makes contact with the lower edge of the guide aperture 25*a* so as to be pivoted about the spindle 20. The relative displacement between the needle and the head therefore is the combination of a rotation about the spindle 20 and a vertical translation. FIGS. 5 and 6 diagrammatically show respectively an intermediate position of the needle and its link with respect to the head 14 and the final engagement position of the fabric.

Figure 7A:
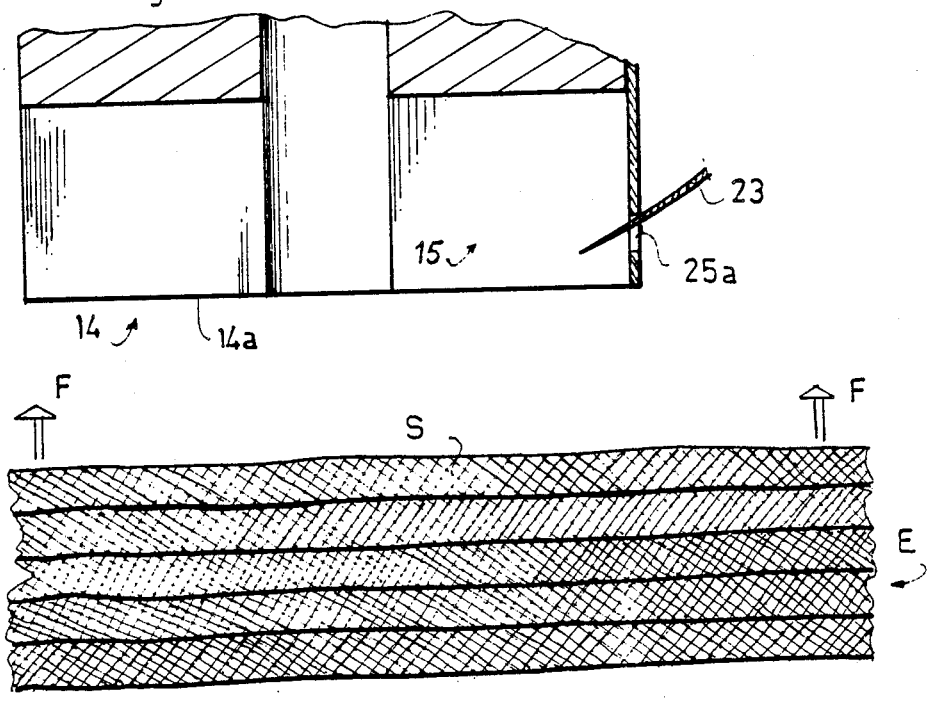
Figure 7B:
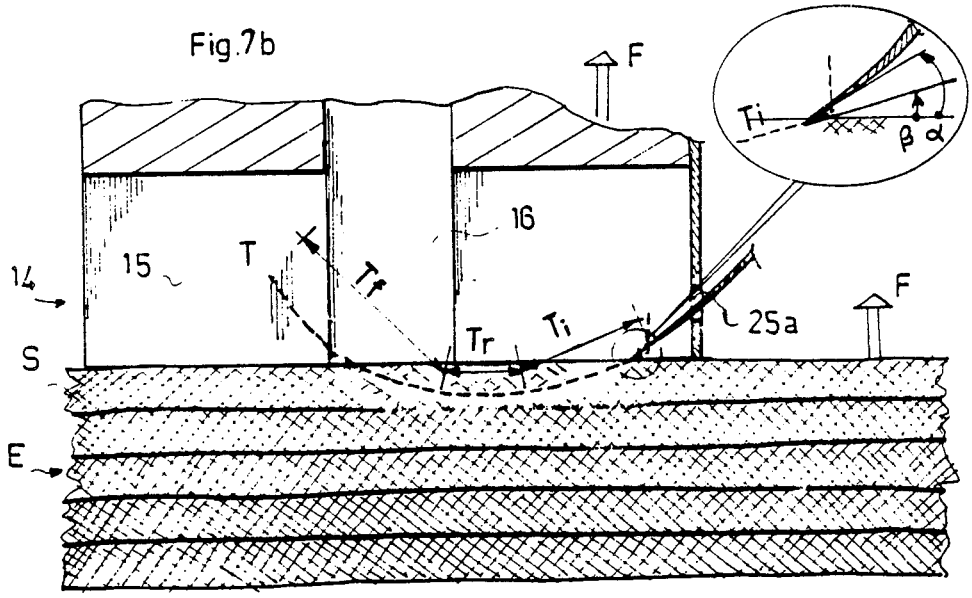

The combination of the above cited motions results in the needle tip 23*a* moving along a path T such as schematically shown in FIG. 7*b*. This path of the needle tip 23*a* is considered with respect to the head, that is taking this head 14 as the reference.

The path T imparted to the needle tip by the described kinematic guides assumes the shape of a "C" with the concave side facing upwards. It comprises successively (a) an initial segment Ti corresponding to the needle descent toward the fabric (in relative motion) and to its penetration, (b) a reversal segment Tr during which the penetration angle alpha passes from a positive to a negative value, and (c) an end segment Tf during which the needle tip rises toward the contact surface 14*a* of the head until it intersects it at the clearance 16 and until it is retracted in the groove 15 on the other side of the vertical axis of the head.

In all these positions, the needle is above the path T. its tip direction (tangent at the tip) is located above the path tangent and subtends with it an angle between a few degrees and 20 degrees.

The schematics of FIGS. 7*a* through 7*g* illustrate the relative motion between the needle and the head 14.

The needle 23 is positioned to be initially retracted within the groove 15 as shown in FIG. 7*a*. The head is in the low position and the jack 12 supporting it communicates with the ambient whereby the head can rise in the presence of low and constant friction forces. The link 21 is in the end stop position and the needle makes contact with the upper edge of the guide aperture 25*a*.

In a first stage the stack symbolized by E in the schematics is made to move upward as indicated by the arrows of FIG. 7*a* until its upper layer S makes contact with the contact surface 14*a* of the head.

At this time, the head will be lifted and will tend to move out of the way upward under the thrust from the stack. The pressure of the contact surface on the stack is substantially constant and fairly low in order not to significantly compress the layers, in particular the upper layer (due to the low and constant forces of the jack 12).

At the beginning of the escaping motion of the head, the needle performs with respect to it a downward vertical motion until coming to rest against the lower edge of the guide aperture 25*a*. At that time, its tip starts moving along the segment Ti of the path until it makes contact with the layer S diagrammatically shown in FIG. 7*b*. During this initial stage of the displacement, the spring 22 provides the needle with good flexibility of displacement and determines an essentially constant needle penetration pressure.

At the instant the needle penetrates the fabric, the penetration angle alpha (i.e. the angle subtended by the fabric plane and the direction of the needle tip) is approximately between 15° and 35° whereby an appropriate entry of the needle tip through the fabric fibers is assured.

This penetration angle alpha is different from the angle beta formed at the same point by the tangent to the path Ti (alpha>beta) because the displacement of the tip is not caused by a rotation about the needle center of curvature. Therefore the needle motion is not restricted to a component of rotation but includes a translation component comprising a sliding motion toward the axis of the head 14 and due to a thrust on the fabric toward this axis. In the case of a needle without at stop, the angle beta subtended by the tangent to the path T and the layer at the penetration point preferably shall be between 3° and 15° whereby an effective thrust on the fabric will be possible from the start of penetration in order to form the corrugation (in the case of a needle with a stop, the magnitude of this angle is less critical because, as shown further below, the thrust exerted on the fabric by the stop is exceedingly effective and sufficient per se).

Figure 7C:
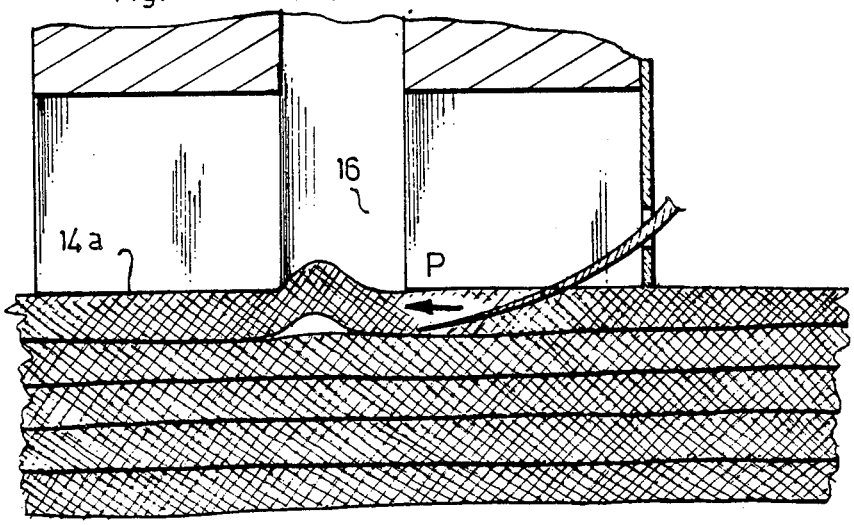
Figure 7D:
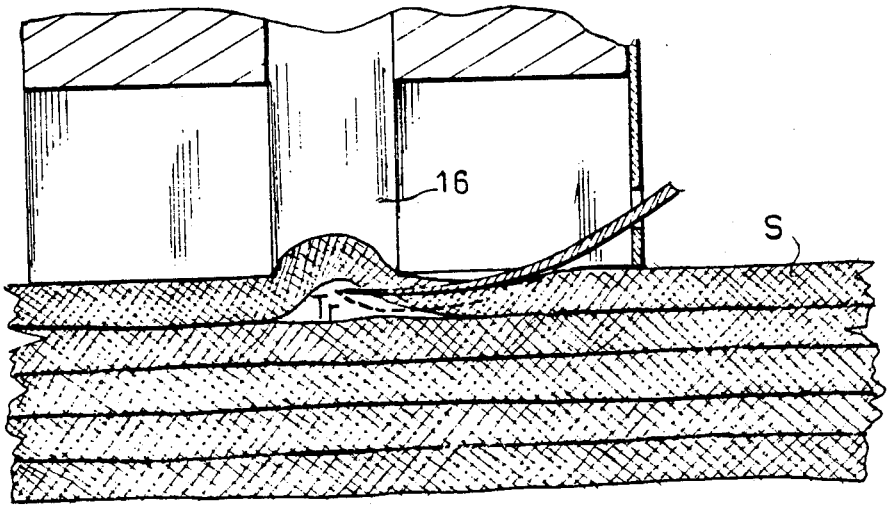

The progressive escaping motion of the head continues as the stack rises. Having entered the fabric, the needle tip moves along the initial path segment Ti and then along the reversing segment Tr (FIG. 7*c*). The fabric is forced back during this motion in the direction of the arrow P and forms a corrugation of increasing height in the clearance 16 of the head.

If only one fabric layer must be seized, the needle holding and guide means are set in such a manner that the reverse motion segment Tr of the path be located from the contact surface 14*a* by a distance equal to or less than the thickness of one layer.

If "n" layers must be seized, this setting takes place in such a manner that the reverse motion segment Tr be located in the lowest of the layers to be seized, that is, at a distance larger than $(n-1)e$, and less than or equal to $n \times e$, where "e" is the thickness of one layer.

When the needle tip arrives at the end of the reverse path segment Tr (FIG. 7*d*), the penetration angle reverses and due to the fabric corrugation the tip exits on the lower side of the layer S without danger of hooking into the layer below (as the tip always remains above this lower layer).

Figure 7E:
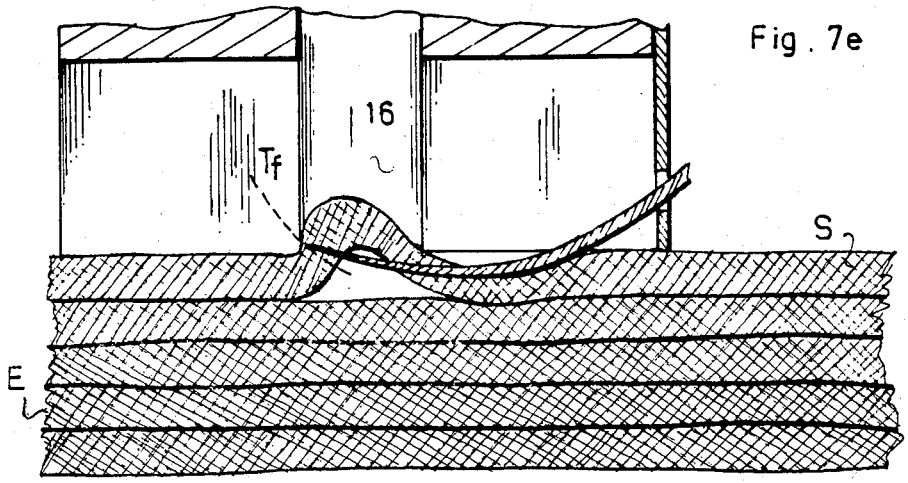

The stack E is being lifted further together with the head's upward escaping motion (FIG. 7*e*). Thereupon, the needle moves along the end path segment Tf which rises with respect to the contact surface and intersects its plane at the clearance 16. The needle tip exiting from the lower fabric side of the layer S again enters into this layer at the corrugation. Moreover, the needle as a whole tends to move out of the way upward into the head groove 15.

Figure 7F:
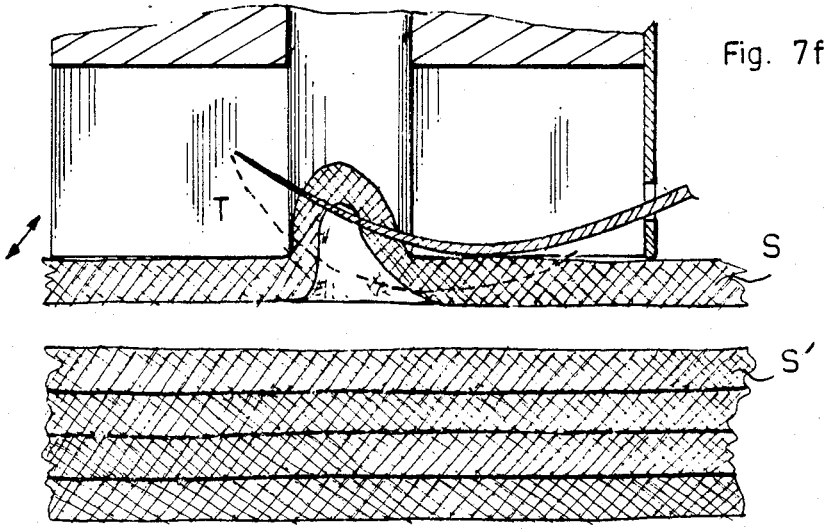

FIG. 7*f* is a schematic of the final needle position when its tip arrives at the path end segment Tf. In that position, the needle tip is retracted inside the head groove 15. In the embodiment shown, the needle has been wholly retracted into this groove. Pierced through at two sites, the fabric is perfectly held by the needle and by the contact surface, incapable of either slipping or detaching.

When in that position, the proximity sensor 26 controls the pneumatic supply of the jack 12, locking the head into the high, escaped position. The firmly held fabric now is locked into this position and cannot detach regardless of the motions impressed on the head and the forces applied to the fabric.

Next, the stack E is made to descend and simultaneously the jack 8 receives several pneumatic pulses forcing rapid to-and-fro motions, in a direction substantially parallel to the plane of the contact surface, to the plate and therefore to the needle-head assembly. Also, air is blown in through the line 4 of which the orifice 4*a* is in the immediate vicinity of the layer S when the head 14 is wholly out of the way in the upper position.

These steps assure an extremely effective detachment of the layer S from the layer S' located directly underneath it. It should be noted that the detachment is achieved in a very reliable manner even in the case of layers strongly adhering to each other. This is due to the effectiveness of the above described detaching operations and furthermore to the fact that sizeable forces of adhesion are then produced between the stack and the undetached layer S' to retain this latter on the stack.

After the layer S is separated from the stack, the motions of jack 8 and the insufflation of air are stopped and the gripping apparatus is moved toward the desired location.

Figure 7G:
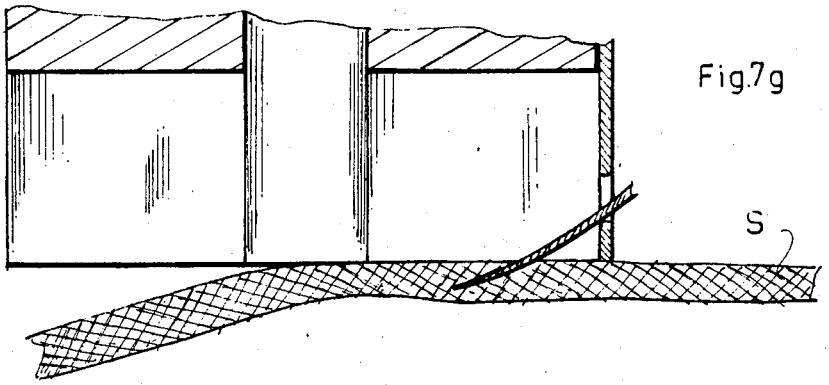

The pneumatic jack 12 is then actuated in the reverse direction to lower the head 14 with respect to the plate 6. The needle 23 is displaced in the inverse direction and frees the fabric layer (FIG. 7*g*). It should be borne in mind that the presence of the spring 22 makes it possible to carry out this motion with all required flexibility. At the end of the stroke, the needle returns to its initial position which is away from the contact surface.

FIG. 8 shows a gripping machine to transfer layers which includes an apparatus of the type described above and equipped with four gripper assemblies 2.

This machine includes a mobile stack support 28 (or several) which is located underneath and opposite one of the locations where the gripping apparatus may be stationed. This stack support or pallet is associated with a jack 29 which allows raising it toward the gripping apparatus, or lowering it again.

The gripping apparatus is carried on transfer means designed to displace between one or more positions located opposite the stack supports (28) and one or more other positions located above sites where the layers must be deposited. In the embodiment shown, these means are schematically indicated by a carriage 30 moving along guide rails 31 and by a drive jack of which the mobile rod appears at 32. The gripping apparatus is suspended from the carriage 30.

The automation of the gripping and transfer operations can be easily implemented by providing control means designed to produce the following cycle: lifting the stack support 28 toward the gripping apparatus until making contact with it in order to cause the withdrawal of its heads 14; lowering the support with rapid to-and-fro motions of the plates 6 with respect to the framework 1 and air insufflation; transfer of the gripping apparatus to another position; driving the heads 14 to achieve the return stage of the needles 23; return of the gripping apparatus toward the stack support cited above, or another.

Clearly, other transfer means can be provided. Again, all the above cited motions are relative motions between members and certainly it would be equivalent to move a first member with respect to a second or, inversely, a second with respect to a first.

Furthermore, the above described machine wherein several assemblies 2 are mounted on the framework 1 and are arranged around its central region in order to reliably grip layers in several zones, preferably calls for synchronization of the actuation of the various jacks 8 during the detachment stage in order to subject the heads 14 to synchronized separation or nearing motions with respect to the central region.

In this way, the seized layer S undergoes a series of tensions and relaxations whereby the effectiveness of its detachment from the lower layer is enhanced further.

To that end, each assembly 2 is arranged in such a manner that the rods of the jacks 8 point in the radial direction (the direction from the assembly 2 toward the central region of the framework) and that each needle is located in a tangential plane perpendicular to this direction. It should be noted that such a tangential position of the needles is highly advantageous to counteract any radial slippage of the fabric while it undergoes tensions and relaxations.

Furthermore, the gripping apparatus can be provided with a needle 33 such as shown in FIG. 9. This needle evinces the overall shape of the needle 23 but is provided at its zone with two separate tips 33*a* and 33*b* which, in this embodiment, comprise beaks with upper oblique faces. At their base, these tips bound a front side 33*c* acting as a stop. The tips 33*a* and 33*b* may be about 5/10 mm thick.

The schematics of FIGS. 10*a*, 10*b* and 10*c* illustrate gripping a layer using such a needle.

First the needle enters the upper layer in the same manner as the previously discussed needle 23 until its stop 33*c* makes contact with the upper side of the layer (FIG. 10*a*).

Its penetration then ceases due to the stop 33*c* and the needle most effectively forces the fabric back toward the clearance 16 of the head. It should be noted in this respect that a reaction force is applied to the needle which thereby tends to retract upwardly against the spring 22*b* (FIG. 10*b*). Accordingly, the path of the needle tip is substantially flatter than in the preceding case, and the danger of accidentally seizing the lower layer is negligible in spite of the thinness of the fabric.

At the end of the motion, the corrugation, which is much more pronounced than in the preceding case, is firmly clamped between the stop 33*c* and the edge opposite the clearance (FIG. 10*c*). The fabric therefore is seized not only be piercing it but also by clamping the corrugations: empirically this gripping action was found to be extremely reliable regardless of the fabric thickness and texture.

A gripping apparatus and an automated machine for transferring fabric pieces were described above. Clearly, the invention also applies to a manual apparatus which includes a single head (or possibly only a small number of heads) which would be manually forced against a stack in order to separate from it one or more upper layers. In that case the jack 12 is replaced by translational guide means for the head. The kinematic needle guides remain similar to those already described, the locking of the head in the withdrawn upward position being implemented by a manually disengageable ratcheting member. A spring with high compliance may be provided to return the head reliably downwardly and to assure the reverse motion of the needle. Such a system is held in place by a handle fixed to the plate.

In certain cases (where the materials adhere strongly to each other), such a system of very simple design facilitates the manual operation of seizing and separating the layers.

We claim:

1. A process for gripping one layer or a specified number of layers of a flexible material arranged in a stack of layers for separating said layer(s) (S) from the other layers of the stack (E), said process comprising moving a contact surface (14*a*) having a clearance (16) above at least one zone of the stack's upper flexible layer (S) until this contact surface makes contact with said layer (S) which remains free at the clearance (16), moving a needle (23) with respect to said contact surface so that its tipped end (23*a*) moves with respect to said contact surface in sequence first in an intitial segment (Ti) starting at the contact surface and deviating from it in such a manner that the needle enters the flexible layer (S), then in a reversing segment (Tr) wherein takes place a change in the relative displacement between the needle tip and the contact surface, and lastly in an end segment (Tf) nearing and extending beyond the contact surface and offset from the initial segment so as not to coincide with it, inplacing the assembly of needle and contact contact surface in a plurality of rapid to-and-fro motions in a direction substantially parallel to the plane of said contact surface and producing a relative separation motion between the stack (E) and the assembly of needle and contact surface, the motion of the needle (23) being caused in such a manner that during the motion of said tip along the initial segment (Ti) and along the reverse segement (Tr) said needle forces the flexible layer (S) toward the clearance (16) and shapes it into a corrugation in said clearance, the end segment (Tf) of the path passing through said corrugation.

2. A gripping process as in claim 1, and including positioning said needle in such a manner that during motion along the initial segment (Ti) and the reversing segment (Tr) the direction of its end does not coincide with the tangent to the path for assuring formation of said corrugation.

3. A gripping process as in claim 2, and wherein during its motion the needle is positioned in such a manner that the direction of its tip is located at each point of its path above the tangent of said path in order to assure a thrust on the flexible layer by favoring its lifting toward the clearance (16) of the contact surface (14*a*).

4. A gripping process as in claim 3, wherein at the start of the initial segment (Ti) of the path, the needle is made to penetrate the upper flexible layer (S) at a penetration angle substantially between 15° and 35°, the ensuing motion of the needle being caused in such a manner that the reversing segment (Tr) be located a distance from the contact surface (14*a*) which is less than or equal to the thickness of the flexible layer(s) (S) to be seized.

5. A gripping process as in claim 4 and wherein the relative motion between the needle (23) and the contact surface (14*a*) is caused by rotating said needle about a spindle (20) in a relative translational motion to the contact surface (14*a*), said spindle being located at the other end of the flexible layers with respect to the plane of the contact surface and tending to come nearer this plane during the relative translational motion.

6. A gripping process as in claim 5, wherein a curved needle with the concave side facing in the same direction as that of the path (T) is used, and wherein the needle motion is caused by a rotation about a spindle (20) which is transversely offset from the center of curvature of said needle, said spindle itself undergoing the above cited translational motion.

7. A gripping process as in claim 1 and wherein said needle has a body portion and at least two furcations forming needle tips, the juncture of said furcations with said body portion forming a stop designed to come to rest against the flexible layer in order to enhance the thrust on this flexible layer.

8. A gripping process as in claim 7 and including providing a needle with associated elastic means to separate it from the contact surface, said needle being mounted in such a manner that it can retract slightly toward the contact surface.

9. A gripping process as in claim 1 and wherein after the relative separation motion of the stack (E) the assembly of needle and contact surface is moved above a site where the flexible layer(s) must be deposited, characterized in that each needle (23) undergoes an inverse displacement with respect to the corresponding contact surface (14*a*) in a manner to return each of said needles to its initial position where it is retracted with respect to the corresponding contact surface.

10. A gripping process as in claim 1 and including placing said contact surface (14*a*) on the upper flexible layer (S) of said stack by a relative nearing motion between said stack and said contact surface implemented in such a manner that following contact the pressure applied by the contact surface on the stack be substantially constant and sufficiently low so as not to substantially compress the flexible layer(s).

11. A gripping process as in claim 1, and including locking said needle in place with respect to the contact surface upon termination of the end segment (Tf) of the needle motion and keeping said needle locked during the relative separtion motion between the stack and the assembly of needle and contact surface.

12. A gripping process as in claim 1 and including seizing said flexible layer(s) in several distinct zones distributed about a central region of these layers by means of a plurality of needles each associated with a contact surface, and wherein the needle motions are implemented in such a manner that their paths (T) be located in approximately tangential planes.

13. A gripping process as in claim 12 causing said rapid to-and-fro motions of each assembly of needle and contact surface in a radial direction substantially perpendicular to the plane of the path of the needle under consideration, the motions of the various assemblies being synchronized so they simultaneously move away from or come closer to the central region of the flexible layer(s) (S) so as to tension and to relax said layer(s).

14. A gripping process as in claim 12 and wherein after the locking of the needles (23) with respect to their respective contact surfaces (14*a*) air is insufflated into the central region of the upper flexible layer (S) in the direction to separate said layer from the planes of the contact surfaces.

15. A gripping apparatus for flexible material layers, including at least one head (14) provided with a contact surface (14*a*) having a clearance (16), a needle (23) associated with said head and movable with respect thereto, and kinematic means for guiding each needle (23) with respect to the corresponding head (14) and forcing on the needle end (23*a*) a path (T) with respect to the contact surface which path comprises an initial segment (Ti), a reversing segment (Tr) and an end segment (Tf) and being in the shape of a C with the concave side directed toward the head's contact surface (14*a*), said needle having a body portion and at least two furcations extending therefrom and terminating in needle tips, the juncture of said furcations and said body portions forming a stop (33*c*) designed to come to rest against the flexible layer.

16. An apparatus as in claim 15, wherein said needle includes at its end two separate tips (33*a*, 33*b*) and a stop (33*c*) comprising the part located between the bases of said tips.

17. An apparatus for gripping layers of flexible material comprising at least one head having a contact surface provided with a passageway, a needle associated with each said head and movable with respect thereto, kinematic guide means for each needle for guiding said needle relative to the corresponsing head and for imparting to the distal end of said needle a generally C-shaped trajectory (T) concave toward the contact surface of said head, each said head including a clearance of a width slightly greater than the width of said needle, said clearance extending along a plane substantially perpendicular to said contact surface and intersecting said passageway of said head, and said kinematic guide means being adapted to impart to said needle a final position at the end of said trajectory in which at least the extremity of said needle is retracted into said groove.

18. A gripping apparatus as in claim 17 and wherein said kinematic guide means is adapted to displace the associated needle according to a movement such that the direction of the extremity of said needle is distinct from a tangent to the trajectory (T) at least along the initial portion of the trajectory.

19. A gripping apparatus as in claim 18 and wherein said needle has an extremity provided with at least one point (33*a*, 33*b*), and a stop upstream from said point for coming into contact against a layer.

20. A gripping apparauts as in claim 19 and wherein said needle includes at its extremity two points and said stop being formed between the bases of said points.

21. A gripping apparatus as in claim 18, and wherein said kinematic guide means is arranged such that the final portion of said trajectory of the needle end intersects the plane of the contact surface at said clearance (16).

22. A gripping apparatus as in claim 17 and wherein said kinematic guide means comprises a hinging link for holding said needle, a hinging spindle for said link and carried by a support whereby said spindle may be transversely offset from said head, translational guide means for enabling a relative translational motion between said support and said head, and a needle guiding aperture for displacing said needle along said trajectory when said head and said support are subjected to said relative translational motion.

23. A gripping apparatus as in claim 22, and including elastic means (22) associated with the needle holding link (21) for acting to separate it from the head (14) toward an end stop position.

24. A gripping apparatus as in claim 22 and wherein said needle is a curved needle carried by the link (21) so that its concave side faces in the same direction as the path (T), and wherein the hinging spindle (20) of said link is located on the concave side of the needle and is transversely offset from the needle center.

25. A gripping apparatus as in claim 22 and wherein said head (14) is mounted in a translationally mobile manner with respect to a plate (6), the support (17) of the hinging spindle being fixed to said plate, translational guide and drive means (14) associated with the head (14) for passively guiding the translation of head (14) during a retraction stage in which the needle end (23*a*) moves along the path (T) and driving the head (14) into a translation reverse of that of the retraction stage when performing a return stage in which the needle end (23*a*) moves along the path (T) in the reverse direction.

26. A gripping apparatus as in claim 25 and wherein said guide and drive means comprises a pneumatic jack (12) associated with a pickup (26) for detecting the retracted position of the head (14) and to actuate the locking of said jack (12).

27. A gripping apparatus as in claim 25 and wherein said support (17) of the hinging spindle (20) is fixed to the plate (6) in a preset relative position, and the needle (23) is fixed on its link (21) in a preset relative position.

28. A gripping apparatus as in claim 25 and wherein each plate (6) is movably mounted on a framework (1) so as to be capable of low amplitude motions with respect to said framework and parallel to the plane of the head's contact surface (14*a*), said plate (6) being associated with drive means (8, 9) for moving it into rapid to-and-fro motions with respect to the framework (1).

29. A gripping apparatus as in claim 28 and wherein several plates (6) each provided with a movable head (14) and a needle (23) are mounted on the framework (1) and are distributed around a central region (1*a*) of said frame to assure gripping the flexible layer(s) at several zones.

30. A gripping apparatus as in claim 29 and wherein said driving means (8, 9) for the various plates with respect to the framework (1) are designed to subject the heads (14) to synchronized separation or nearing motions with respect to the central region (1*a*) of the framework.

31. A gripping apparatus as in claim 29 and including air blowing means (4, 5) at the framework central region (1*a*) arranged at a direction intersecting the plane of the contact surfaces (14*a*).

32. A gripping apparatus as in claim 29 and wherein said plates (6) are mounted on the framework (1) in such a manner that each needle (23) is located in a plane tangent to a center in the framework central region (1*a*).

33. A gripping apparatus as in claim 17 and wherein said needle has an extremity provided with at least one point (33*a*, 33*b*, and a stop upstream from said point for coming into contact against a layer.

34. A gripping apparatus as in claim 33 and wherein said needle includes at its extremity two points and said stop being formed between the bases of said points.

35. An apparatus for gripping one or more layers of flexible material and for transferring the gripped layer(s) comprising at least one head having a contact surface provided with a passageway, a needle associated with said head and movable with respect thereto, kinematic guide means for each needle for guiding said needle relative to the corresponding head and for imparting to the distal end of said needle a generally C-shaped trajectory (T) concave toward the contact surface of said head, each said head including a clearance of a width slightly greater than the width of said needle, said clearance extending along a plane substantially perpendicular to said contact surface and intersecting said passageway of said head, said kinematic guide means being adapted to impart to said needle a final position at the end of said trajectory in which at least the extremity of said needle is retracted into said groove, mobile stack support means positioned beneath said contact surface, and means for moving said stack support means toward and away from said contact surface.

36. A machine as in claim 35 and including transfer means (30, 31, 32) for moving said gripping apparatus between one or more positions located opposite said stack support means (28) and one or more positions located above the sites where the layers are to be deposited, control means for directing the following cycle: raising the stack support (28) toward the gripping apparatus until it makes contact in order to produce the escape stages of its heads (14), lowering said support with rapid to-and-fro motions of the plates (6) with respect to the framework (1) and air insufflation, transferring the gripping apparatus to another position, driving the heads (14) to generate the return stage of the needles (23), return of the gripping apparatus to the above cited or another stack support.

* * * * *